US005470653A

United States Patent [19]

Honeycutt et al.

[11] Patent Number: 5,470,653

[45] Date of Patent: Nov. 28, 1995

[54] DISPOSABLE MOP HEADS

[75] Inventors: Travis W. Honeycutt, Gainesville; Baosheng Lee, Duluth, both of Ga.; James R. Shreffler, Weaverville, N.C.

[73] Assignee: Isolyser Company, Inc., Norcross, Ga.

[21] Appl. No.: 286,811

[22] Filed: Aug. 5, 1994

[51] Int. Cl.[6] ..... D02G 3/00

[52] U.S. Cl. ..... 428/357; 428/224; 428/284; 15/228; 15/229.1; 15/147.1

[58] Field of Search ..... 15/228, 229.1, 15/147.1; 428/224, 357, 284; 525/62, 56

[56] References Cited

U.S. PATENT DOCUMENTS

| | | | |
|---|---|---|---|
| 2,340,866 | 2/1944 | Dangelmajer . | |
| 2,395,616 | 2/1946 | Dangelmajer . | |
| 2,408,377 | 10/1946 | Dangelmajer . | |
| 2,430,949 | 11/1947 | Porter etal. . | |
| 2,909,502 | 10/1959 | Matsumoto et al. . | |
| 3,089,493 | 5/1963 | Galindo . | |
| 3,314,809 | 4/1967 | Klug . | |
| 3,372,311 | 3/1968 | Lobur . | |
| 3,413,229 | 11/1968 | Bianco et al. . | |
| 3,484,874 | 12/1969 | Bickenheuser, Jr. . | |
| 3,578,619 | 5/1971 | Reeder . | |
| 3,607,812 | 9/1971 | Takigawa et al. . | |
| 3,637,657 | 1/1972 | Morii et al. . | |
| 3,698,030 | 10/1972 | Lockett | 15/228 |
| 3,762,454 | 10/1973 | Wilkins, Jr. . | |
| 3,790,067 | 2/1974 | Scheier . | |
| 3,859,125 | 1/1975 | Miller et al. . | |
| 3,865,918 | 2/1975 | Mitchell et al. . | |
| 3,886,112 | 5/1975 | Watson et al. . | |
| 3,886,610 | 6/1975 | Shelden . | |
| 3,931,088 | 1/1976 | Sakurada et al. . | |
| 4,073,733 | 2/1978 | Yamauchi et al. . | |
| 4,079,036 | 3/1978 | Ohmori et al. . | |
| 4,279,752 | 7/1981 | Sueoka et al. . | |
| 4,295,850 | 10/1981 | Haberli et al. . | |
| 4,343,133 | 8/1982 | Daniels et al. . | |
| 4,478,971 | 10/1984 | Ballard | 524/376 |
| 4,620,999 | 11/1986 | Holmes . | |
| 4,651,725 | 3/1987 | Kifune et al. | 128/156 |
| 4,863,779 | 9/1989 | Damponte | 428/284 |
| 4,952,550 | 8/1990 | Wallach et al. . | |
| 4,959,341 | 9/1990 | Wallach . | |
| 4,959,464 | 9/1990 | Yeh . | |
| 5,051,222 | 9/1991 | Marten et al. . | |
| 5,106,890 | 4/1992 | Maruhashi et al. . | |
| 5,181,966 | 1/1993 | Honeycutt et al. . | |
| 5,181,967 | 1/1993 | Honeycutt . | |
| 5,183,571 | 2/1993 | Hanel et al. . | |
| 5,207,837 | 5/1993 | Honeycutt . | |
| 5,208,104 | 5/1993 | Ueda et al. | 428/364 |
| 5,225,120 | 7/1993 | Graiver et al. | 264/28 |
| 5,252,340 | 10/1993 | Honeycutt | 424/489 |

FOREIGN PATENT DOCUMENTS

| | | |
|---|---|---|
| 8902229 | of 0000 | Brazil . |
| 0107576A2 | of 0000 | European Pat. Off. . |
| 0176316A2 | of 0000 | European Pat. Off. . |
| 0272816A2 | of 0000 | European Pat. Off. . |
| 0050288A1 | of 0000 | European Pat. Off. . |
| 1519530 | of 0000 | Germany . |
| 3017246A1 | of 0000 | Germany . |
| 60-44897 | of 0000 | Japan . |
| 59-100704 | of 0000 | Japan . |
| 2-68396 | of 0000 | Japan . |
| 63-200764 | of 0000 | Japan . |
| 55-71532 | of 0000 | Japan . |
| 47-41741 | of 0000 | Japan . |
| 61-159995 | of 0000 | Japan . |
| 1374199 | of 0000 | United Kingdom . |
| 1312370 | of 0000 | United Kingdom . |
| 1271424 | of 0000 | United Kingdom . |
| 1187690 | of 0000 | United Kingdom . |
| 2248842 | of 0000 | United Kingdom . |
| 2227245 | of 0000 | United Kingdom . |
| 2211196 | of 0000 | United Kingdom . |
| 2211088 | of 0000 | United Kingdom . |
| 2119709 | of 0000 | United Kingdom . |
| 2102461 | of 0000 | United Kingdom . |
| 2083762 | of 0000 | United Kingdom . |
| 1451619 | of 0000 | United Kingdom . |
| 743165 | of 0000 | United Kingdom . |
| 386161 | of 0000 | United Kingdom . |
| WO91/17210 | of 0000 | WIPO . |
| WO80/01374 | of 0000 | WIPO . |

*Primary Examiner*—N. Edwards
*Attorney, Agent, or Firm*—Malcolm B. Wittenberg

[57] ABSTRACT

A mop head comprising a bundle of fibers bound together to create mop head fabric. The fibers are composed of polyvinyl alcohol which is water soluble at temperatures above approximately 93° C. The polyvinyl alcohol fibers are produced by a process of dope extrusion and which contain wetting and anti-blocking agent.

12 Claims, No Drawings

DISPOSABLE MOP HEADS

BACKGROUND Of THE INVENTION

Hospital patient care generates considerable quantities of infectious medical waste in primary and acute care facilities. There has been a general conversion from reusable, cleanable items, to disposable items over the last three decades. These conversions were made to promote antiseptic techniques in patient care and to decrease the potential for cross-infections between patients, staff and the general public. Recent federal and state government regulations such as the Medical Waste Tracking Act of 1988 and OSHA Medical Facility rules have resulted in a substantial increase in medical waste that must be classified as "infectious."

When a patient is admitted to a hospital, the patient produces approximately 55 pounds of medical waste per day. Approximately 20% of this waste is infectious. The current stated objective of the American Hospital Association and the Centers for Disease Control is to treat medical waste as soon as it is generated. Both organizations recognize that medical waste is primarily an occupational hazard for health care workers and not an environmental problem. The best way to deal with infectious medical waste is to disinfect it at the point of generation and dispose of the treated medical waste with minimum handling and storage on premises. The need for an effective way to dispose of medical waste has been highlighted by the amendment made to 29 C.F.R. §1910.1030 which provides for the federal regulation under the Occupational Safety And Health Act, 29 U.S.C. 655, 657 to control bloodborne pathogens. Specifically, the Act calls for the establishment of an exposure control plan, the containment of specimens of blood or other potentially infectious materials and the general tightening of precautionary measures to minimize the spread of disease. A safe and effective way to dispose of hospital waste would greatly facilitate compliance with the above-referenced Act.

As a result, consumption of medical disposable woven or non-woven products has been growing at a rate of approximately 10% a year. In 1988, sales totaled approximately 1.155 Billion Dollars. It is projected that by 1994, sales of medical disposable non-woven products will exceed two Billion Dollars. In the United States, there are approximately 30 million surgical procedures performed each year. After each surgical procedure, it is necessary that the operating theater be disinfected before a new procedure is performed. To minimize any exposure the patients may bring to other patients or staff. This is particularly important in light of today's increasingly stringent regulations regarding occupational exposure to blood and bodily fluids.

One of the most basic operations that is performed in the surgical theater as well as in the clinical environment, generally, is the mopping 15 of floors. Fundamentally, cleaning a floor is perhaps one of the most hazardous duties in the hospital because likely infectious material will reside in the floor in the form of spills, splashes, drips or general runoff of potentially hazardous fluids such as blood, bodily liquids and irrigation products which are present involved in virtually all operating procedures. Currently, floors are cleaned by employing conventional tools such as mops. It is a common practice in today's surgical venues or hospital's surgical centers that conventional mops are used once and either disposed of via landfill or incineration or are washed, dried, sterilized and reused. It is practically impossible to clean a used mop head to remove all of the pathogens, infectious materials, needles, and other sharp objects that are caught in the interstices in the yarn constituting the mop itself. Cleaning the mop leads to considerable opportunity for additional exposure to people that are employed to clean the mops after they are used. Furthermore, conventional mops, when disposed of either through landfill or incineration, provide ample opportunity for reinfection.

It is thus an object of the present invention to provide a suitable mop head capable of being disposed of after use while avoiding additional burdens being placed upon landfills and other disposal sites.

It is yet a further object of the present invention to provide a suitable mop head which, after use, can be solubilized and substantially sterilized in a single operation.

These and further objects will be more readily appreciated when considering the following disclosure and appended claims.

SUMMARY OF THE INVENTION

The present invention involves a mop head and its method of disposal after use. The mop head fabric is comprised of fibers of polyvinyl alcohol which is water soluble at temperatures above approximately 93° C. The polyvinyl alcohol fibers are produced by a process of dope extrusion and then treated with heat and stretching, the degree of crystallinity and the degree of orientation for the heated and stretched polyvinyl alcohol fibers are approximately 0. 70 and 0.52, respectively. The degree of crystallinity and the degree of orientation are measured by IR spectroscopy. The degree of crystallinity is the ratio of crystalline area to amorphous area. The degree of orientation is the ratio of non-oriented area to oriented area. The water content of polyvinyl alcohol fiber is kept at a value between approximately 1.5 to 15.0% (wt.). The polyvinyl alcohol is further characterized as having a degree of polymerization between approximately 1300 to 1500 being produced from greater than 99% saponified polyvinyl acetate containing between approximately 0.1 to 5.0% (wt.) of an anti-blocking agent and 0.1 to 2.0% (wt.) of wetting agent.

DETAILED DESCRIPTION OF THE INVENTION

As noted, the present invention deals with a novel mop head and its method of disposal for use primarily in the medical industry in hospitals, out-patient facilities and home environments. At such facilities, mop heads generally come into contact with human bodily fluids such that disposal and disinfection has become a matter of major concern in light of the lack of biodegradability of prior products and the potential spread of human fluid-borne diseases such as hepatitis B and AIDS. In order to cope with these difficulties, it is proposed that suitable mop heads be composed of fabric produced from fibers comprising polyvinyl alcohol which is water soluble at temperatures only above 93° C. If the mop heads were soluble at lower temperatures, inadvertent solubilization would occur in the event that the mop heads were to contact certain fluids above room temperature such as recently spilled human blood or urine. Working with polyvinyl alcohol which dissolves only at higher temperatures such as above 93° C. would prevent inadvertent solubilization yet remain ideal in practicing the present invention. In fact, it is contemplated that disposal in a hot water bath such as a washing machine at or near the boiling point of water dedicated solely to solubilizing mop heads or other similar films, fibers and garments would also be an effective disinfecting media. As such, two objectives would be accomplished, namely, that the polymer would be disinfected and would be solubilized for disposal through the sewer system. Not only would this lessen the burden now being imposed upon current landfill sites, but liquid sewer disposal would prove a comparative low cost technique in ridding the user of soiled mop heads.

Conventional mop heads are generally made from cotton or cellosic fiber. Yarn sizes are generally 1 cotton count to 0.1 cotton count and are generally present in the form of multiple plies, such as 2-ply, 3-ply or 4-ply. A typical cotton count would be 0.7/4-ply yarn. These yarns are bundled together, parallel and formed into a mop head by sewing a binding along the mid portion of the mop head in a perpendicular fashion to the threads. Cotton mop heads are generally made from waste, whereas rayon mop heads are generally made from virgin fiber. The typical mop weighs from 16 to 24 ounces.

Mop heads of the present invention are made from fabrics which are in turn created from fibers of polyvinyl alcohol. The fabric, comprised of polyvinyl homopolymer, has been highly crystallized by postdrawing or by heat annealing. Ideal for use in the present invention would be a highly crystallized, greater than 99% saponified polyvinyl acetate.

The mop head fabric can be configured from conventional spun yarn. However, it is preferable to process the fiber into a thermal bond, chemical bond needle punch, wet laid, air laid or other non-woven fabric utilizing tools, methods and procedures familiar to those practicing textile manufacturing art. The preferred weight of fabric is between 15 g/yd. and 100 g/yd. which has been formed from approximately 10 and 50 layers which are affixed along their midsection of the fabric perpendicular to at least one border thereof either by stapling, sewing or otherwise combining the layers together. The fabric layers can then be cut on each side to within an inch or so of their sewn together mid-section to form tendrils that are from ¼" wide to 1" wide. Typically, a 6" wide mop head would have a nominal length of 16" with 30 layers of fabric producing numerous tendrils.

The polyvinyl alcohol fibers are created by a process of dope extrusion. In this process, PVA is dissolved in water under heat and is extruded into a saturated aqueous solution of glauber's salt through fine holes of a spinneret, then dehydrated and coagulated, and formed into fiber shape. The PVA fiber thus spun is then heat treated at a high temperature, but for the purpose of improving the fiber strength, a suitable stretching treatment is given prior to the treatment. The degree of crystallinity ad the degree of orientation for the heated and stretched polyvinyl alcohol fibers are approximately 0.70 and 0.52, respectively. The water dissolution temperature of PVA fibers is increased by the heat treatment. As such, the polyvinyl alcohol fibers will not dissolve at room temperature but will in water at temperatures higher than 93° C. It is contemplated that the final polyvinyl alcohol have between approximately 1.5 to 15% (wt.), preferably 5 to 10% (wt.) and most preferably approximately 7.5% (wt.) moisture content.

In order to further enhance the usability of polyvinyl alcohol in producing the present mop head, it is contemplated that an anti-blocking agent be employed to reduce hydrogen bonding between adjacent hydroxyl groups on separate fiber bundles. Suitable anti-blocking agents and members selected from the group consisting of silicon dioxide ($SIO_2$) polymer, talc, calcium carbonate and fumed hydrophilic $SIO_2$. Such material should be employed between 0.1 to 5% (wt.) and most preferably between 2 to 3% (wt.) based upon the weight of the polyvinyl alcohol.

The polymer for use herein is comprised of polyvinyl alcohol with or without acetyl groups, cross-linked or uncross-linked. It is proposed that the polyvinyl alcohol be substantially fully hydrolyzed, that is, having greater than 99% hydrolyzed acetyl groups.

For the sake of adequate mechanical strength, polyvinyl alcohol fibers should have a degree of polymerization of at least 1300 and no greater than approximately 1500. Ideally, such material should have a degree of polymerization of approximately 1400 and be substantially crystallized.

As also noted that in producing polyvinyl alcohol resins from the saponification of polyvinyl acetate, impurities such as sodium acetate and sodium sulfate are found in the resin. To provide a suitable fiber, such impurities must be kept below ½% (wt.) or preferably below ¼% (wt.) of the polyvinyl alcohol resin. This can be accomplished with a methanol water rinse or extraction.

It is oftentimes desirable that the fiber be colored with pigments or dyes such as azo or anthraquinone molecules. The pigments and dyes should be employed in an amount between approximately 0.5 to 3.0% (wt.) based upon the weight of the polymeric polyvinyl alcohol.

Surprisingly, it has been found that the incorporation of a wetting agent within the polyvinyl alcohol fiber or fabric is quite a useful adjunct to maximize rate of absorbency. A suitable wetting agent includes fluorocarbons offered by the Minnesota Mining and Manufacturing Co. sold under its trademark FC-171. This material is useful in the range of between 0.1 to 2.0% (wt.) based upon the weight of the polyvinyl alcohol polymer.

In producing the present mop head according to the above-noted teachings, that is, from polyvinyl alcohol fibers that are hot water soluble only, suitable mop heads can be used in various cleaning procedures. Subsequent to use, mop heads can be introduced to a boiling water washing machine for from between 5 and 30 minutes at a temperature of 93° C. with a subsequent solution of the mop head and resulting sewer disposal.

EXAMPLES

Tests were conducted to compare the absorption characteristics of mop heads produced pursuant to the present invention with conventional mop heads of rayon and cotton. Mop heads of polyvinyl alcohol of one-ply, two-ply and three-ply thermal bond construction as well as chemical bonded fabric were examined. The various mops were weighed dry and were then soaked in a fluid for five minutes and weighed. The mops were then wrung to squeeze out absorbed fluid and then reweighed semi-dry. The weight of fluid loss from squeezing was calculated by subtracting the semi-dry weight from the wet weight and this was divided by the total weight of wet pick-up and multiplied by 100 to achieve a percentage of water being squeezed from the wet mop head. The various mop heads were then subjected to liquid and their ability to reabsorb liquid was measured. As a result, the following table was generated:

| Samples (wt. in gm) | 1 ply | 2 plies | 3 plies | Rayon | Cotton | Chem bond |
|---|---|---|---|---|---|---|
| ABSORB TEST | | | | | | |
| dry weight (A) | 5.17 | 8.38 | 10.48 | 13.38 | 13.7 | 4.07 |
| wet weight (B) | 38.11 | 47.78 | 51.8 | 57.46 | 23.2 | 42.43 |
| wet pick-up (C) = B − A | 32.94 | 39.41 | 41.32 | 44.08 | 9.5 | 38.36 |
| % wet pick-up (D) = C × 100/A | 637 | 470 | 394 | 329 | 70 | 942 |
| semi-dry wt. after wiring (E) | 11.56 | 19.72 | 25.05 | 32.7 | 19.72 | 13.04 |
| water out from wring (F) = B − E | 26.55 | 28.07 | 26.75 | 24.76 | 3.48 | 29.39 |
| % of water out (G) = F × 100/C | 80 | 71 | 64 | 56 | 37 | 76 |
| REABSORBED TEST | | | | | | |
| wet weight (H) | 34.69 | 49.29 | 53.52 | 56.88 | 35.56 | 38.92 |
| reabsorbed fluid (I) = H − E | 23.13 | 29.57 | 28.47 | 24.18 | 15.84 | 25.88 |
| % of reabsorbed fluid (J) = I × 100/E | 200 | 150 | 113 | 74 | 80 | 198 |

From the above, it is quite apparent that mop heads produced according to the present invention perform quite favorably when compared to current commercially available products.

We claim:

1. A mop head comprising a bundle of fibers bound together to create said mop head fabric, said fibers comprising polyvinyl alcohol which is water soluble at temperatures only above approximately 93° C., said polyvinyl alcohol fibers being produced by a process of dope extrusion and then treated with heat and stretching, the degree of crystallinity and the degree of orientation for the heated and stretched polyvinyl alcohol fibers are approximately 0.70 and 0.52, respectively, and wherein the water content of the polyvinyl alcohol fiber is kept at a value between approximately 1.5 to 15.0% (wt.), said polyvinyl alcohol having a degree of polymerization between approximately 1300 to 1500 being produced from greater than 99% saponified polyvinyl acetate.

2. The mop head of claim 1 wherein said polyvinyl alcohol fibers further contain approximately 0.1 to 5.0% (wt.) of an anti-blocking agent.

3. The mop head of claim 1 wherein said polyvinyl alcohol fibers are thermally bonded together to create said mop head.

4. The mop head of claim 1 wherein said polyvinyl alcohol fibers are chemically bonded and needle punched to create said mop head.

5. The mop head of claim 1 wherein said polyvinyl alcohol fibers are wet laid to create said mop head.

6. The mop head of claim 1 wherein said polyvinyl alcohol fibers are air laid to create said mop head.

7. The mop head of claim 1 wherein said mop head fabric is of from approximately 15 g/yd$^2$ and 100 g/yd$^2$ in weight.

8. The mop head of claim 1 wherein said mop head is formed from approximately 10 to 50 layers of fabric affixed to each other along the approximate mid section of the fabric perpendicular to at least one border thereof.

9. The mop head of claim 8 wherein the fabric layers are cut to lengths on each side of said mid section.

10. The mop head of claim 9 wherein the fabric is cut to approximately 1" in length and approximately ¼" to 1" in width.

11. The mop head of claim 1 wherein said polyvinyl alcohol fibers further contain approximately 0.1 to 2.0% (wt.) of a wetting agent.

12. A mop head comprising a bundle of fibers bound together to create said mop head, said fibers comprising polyvinyl alcohol, approximately 0.1 to 5.0% of an anti-blocking agent based upon the weight of the polyvinyl alcohol and approximately 0.1 to 2.0% of a wetting agent based upon the weight of the polyvinyl alcohol, said polyvinyl alcohol being characterized as being water soluble at temperatures only above 93° C., said polyvinyl alcohol fibers being produced by a process of dope extrusion and then treated with heat and stretching, the degree of crystallinity and the degree of orientation for the heated and stretched polyvinyl alcohol fibers are approximately 0.70 and 0.52, respectively, and wherein said water content of the polyvinyl alcohol fiber is kept at a value between approximately 1.5 to 15.0% (wt.), said polyvinyl alcohol having a degree of polymerization between approximately 1300 to 1500 being produced from greater than 99% saponified polyvinyl acetate.

* * * * *